US005241327A

United States Patent [19]

Rubin et al.

[11] Patent Number: 5,241,327

[45] Date of Patent: Aug. 31, 1993

[54] METHOD AND APPARATUS FOR REMOVING UNTACKED TONER FROM IMAGES

[75] Inventors: Bruce J. Rubin; Peter G. Evans; William Mey; Robin A. Dispenza, all of Rochester; Dennis R. Kamp, Spencerport; Kevin E. Yousey, Brockport, all of N.Y.

[73] Assignee: Eastman Kodak Company, Rochester, N.Y.

[21] Appl. No.: 891,893

[22] Filed: Jun. 1, 1992

[51] Int. Cl.[5] ..... B41J 2/48; G03G 21/00

[52] U.S. Cl. ..... 346/76 L; 346/1.1; 355/305

[58] Field of Search ..... 346/76 R, 76 L, 1.1; 355/270, 285, 305, 306; 430/108

[56] References Cited

U.S. PATENT DOCUMENTS

| | | | |
|---|---|---|---|
| 2,965,756 | 12/1960 | Vyverberg | 25/49.5 C |
| 3,665,373 | 4/1972 | Fisher et al. | 96/1.4 |
| 3,914,046 | 10/1975 | Tanaka et al. | 355/297 |
| 3,923,004 | 10/1975 | Eichorn et al. | 118/637 |
| 4,142,165 | 2/1979 | Miyakawa et al. | 355/270 |
| 4,263,390 | 4/1981 | Yamashita et al. | 430/125 |
| 4,515,467 | 5/1985 | Suzuki | 355/305 |
| 4,706,320 | 11/1987 | Swift | 15/1.5 R |
| 4,754,304 | 6/1988 | Ohashi et al. | 355/270 |
| 4,855,206 | 8/1989 | Saha | 430/108 X |
| 4,999,679 | 3/1991 | Corbin et al. | 355/303 |

FOREIGN PATENT DOCUMENTS

| | | | |
|---|---|---|---|
| 57-79979 | 5/1982 | Japan | 355/305 |
| 61-283569 | 12/1986 | Japan | 346/76 L |

*Primary Examiner*—Joan H. Pendegrass
*Attorney, Agent, or Firm*—Leonard W. Treash, Jr.

[57] ABSTRACT

A method and apparatus for producing an image on an imaging member. The apparatus includes a magnetic brush for depositing a substantially uniform layer of thermoplastic toner particles onto the imaging member. A laser scanner device is utilized to imagewise heat selected toner particles such that the selected toner particles are lightly tacked to the imaging member. The imaging member is contacted by a second magnetic brush, which includes a supply of magnetic carrier particles preferably having a coercivity of greater than about 100 oersteds, at least two times to remove nonselected toner particles from the imaging member. Alternatively, the imaging member may be contacted by two separate magnetic brushes at least one time to remove nonselected toner particles from the imaging member.

21 Claims, 2 Drawing Sheets

METHOD AND APPARATUS FOR REMOVING UNTACKED TONER FROM IMAGES

CROSS-REFERENCE TO RELATED APPLICATION

This application is related to the commonly assigned, co-pending U.S. patent application Ser. No. 632,698, filed in the names of Kamp et al. on Dec. 24, 1990 and entitled "HIGH SPEED, LOW POWER PRINTER".

BACKGROUND OF THE INVENTION

1. Technical Field of the Invention

The present invention relates generally to image reproduction apparatus and, more specifically, to an improved method and apparatus by which untacked toner particles are removed from an imaging member.

2. Background Art

The cross-referenced application discloses a method and apparatus for producing images on an imaging member. Such apparatus utilizes a moving imaging member onto which a substantially uniform layer of thermoplastic toner particles is deposited. The toner particles are imagewise heated by a scanning, intensity-modulated laser beam which lightly tacks selected toner particles to the imaging member. Those toner particles which are not tacked to the imaging member (nonselected toner particles) are removed from the imaging member by an electrically biased magnetic brush utilizing "hard" magnetic carrier particles. This produces an image on the imaging member.

As the speed of the imaging member is increased, it is necessary to increase the electrical bias on the magnetic brush and the RPM on the magnetic core in order to assure that substantially all the nonselected toner particles will be removed from the imaging member in one pass. As the electrical bias is increased, "carrier pick-up" starts to occur. "Carrier pick-up" refers to the undesired adhesion or entrapment of carrier particles to the imaging member following contact by the magnetic brush. These unwanted carrier particles will cause defects in image quality. As a result, the speed with which images can be produced is limited. Of course carrier pickup can occur anytime the electrical bias on the magnetic brush is too high, irregardless of imaging member speed.

SUMMARY OF THE INVENTION

In view of the foregoing discussion, an object of this invention is to provide an improved method and apparatus of the above type which is capable of producing high quality toner images with essentially no carrier pick-up.

According to the invention, toner images are formed on an imaging member with substantially no carrier pickup. Like the prior art, such apparatus includes means for depositing a substantially uniform layer of thermoplastic toner particles onto a moving imaging member and a laser scanner device for imagewise heating selected toner particles such that the selected toner particles are lightly tacked to the imaging member. In contrast with the prior art apparatus, however, the apparatus of the present invention includes means for contacting the imaging member with an electrically biased magnetic brush, utilizing hard magnetic carrier particles, at least two times whereby substantially all nonselected toner particles are removed from the imaging member while depositing essentially none of the hard magnetic carrier particles on the imaging member. Preferably, means are provided for biasing the magnetic brush at a first potential during the first time the imaging member is contacted by the magnetic brush and at a second, lower potential during the second time the imaging member is contacted by the magnetic brush.

Alternatively, means are provided for contacting the imaging member with two separate electrically biased magnetic brushes at least one time whereby substantially all nonselected toner particles are removed from the imaging member while depositing essentially none of the hard magnetic carrier particles on the imaging member. Preferably, the brushes are electrically isolated and the first brush encountered by the imaging member is biased at a higher potential than the second brush.

Other objects and advantages will become more apparent to those skilled in the art from the ensuing detailed description of the preferred embodiments.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
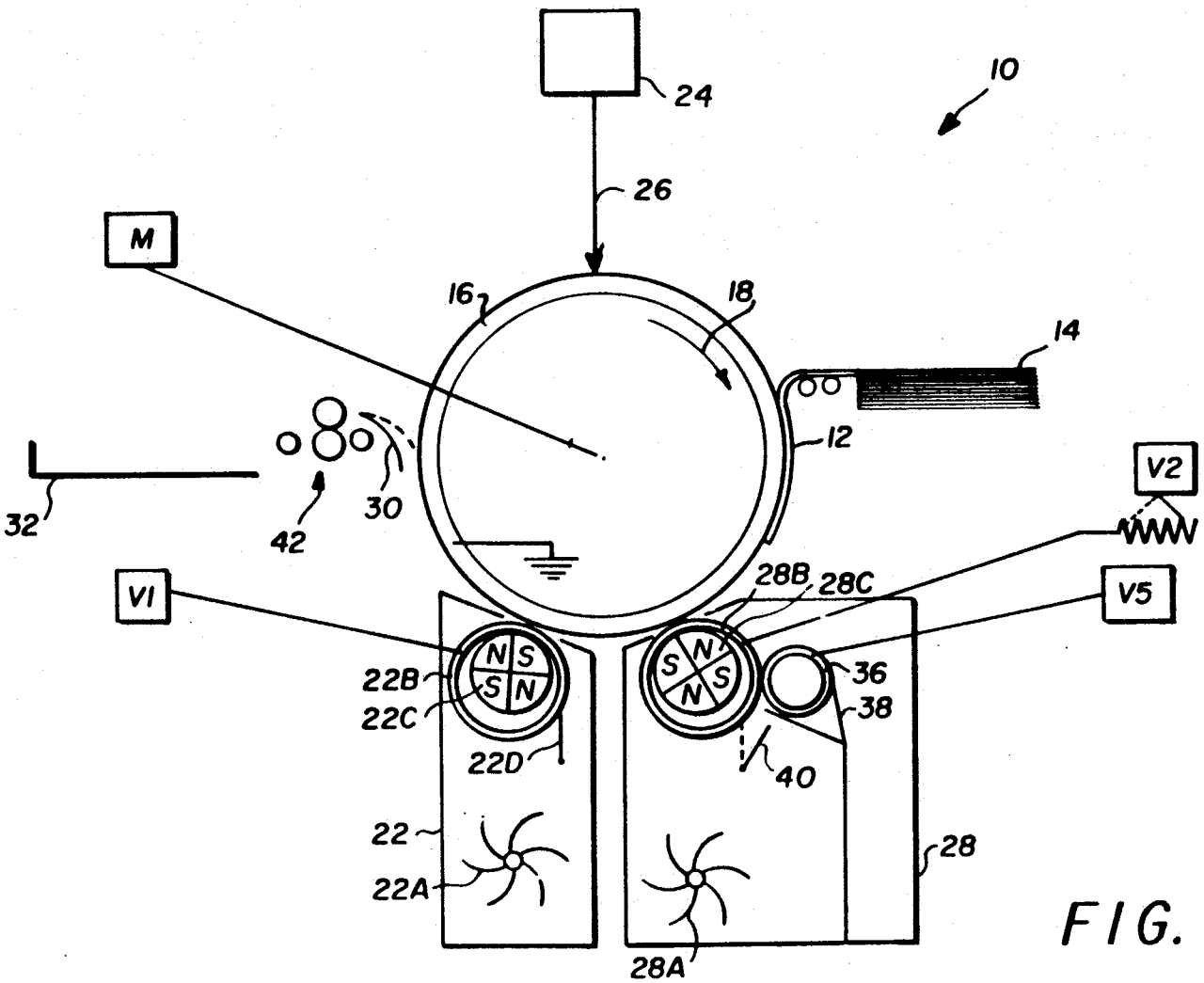
FIG. 1 is a side schematic illustration of an image reproduction system embodying the invention.

Turning now to FIG. 1, an image reproduction apparatus, designated generally by the reference numeral 10, is shown. An imaging member 12 is fed from an imaging member supply 14 onto a process drum 16. Drum 16 includes an outer conductive layer which is connected to ground. The imaging member can be made of a variety of materials such as (1) a plain piece of paper, (2) a metal plate or (3) a support layer, such as Kodak Estar TM film base, over which lies a thin, essentially transparent conductive layer, such as cuprous iodide, and a thermoplastic outer layer 17 composed of a material such as poly-iso-butylmethacrylate. The paper and metal plate imaging members can optionally include a thermoplastic outer layer. For purposes of illustration (3) will be used in the following description.

Imaging member 12 is held to the process drum by conventional means, such as with the use of a vacuum applied through vacuum holes(not shown) in the surface of process drum 16. The process drum is rotated by a motor M in the direction of an arrow 18 at a surface velocity of preferably about 10 cm/s.

An electrically biased magnetic brush 22 contains toner particles and magnetic carrier particles (not shown) which together constitute developer mixture. The toner particles include a pigment, such as carbon, in a thermoplastic binder. The toner and carrier particles are triboelectrically charged to opposite polarities by a rotating auger 22A and are thus attracted to each other. The developer mixture is deposited on a shell 22B by the auger and remains there due to the carrier particles' attraction to a magnetic core 22C located within shell 22B. The shell is made of a nonmagnetic, conductive material while the core is composed of a series of alternating pole magnets. The core and/or the shell are rotated during operation of brush 22.

As the lead edge of imaging member 12 reaches the interface between shell 22B and drum 16, an electrical bias of several hundred volts and of the same polarity as the charge on the toner particles is applied to shell 22B by a voltage supply V1. This creates an electric field between the shell and the grounded conductive layer of drum 16 or the imaging member 12. Toner particles leave the carrier particles on shell 22B under the influence of this electric field and are deposited in a substantially uniform layer on the imaging member. The toner particles are attracted to the grounded conductive layer. The oppositely charged carrier particles remain on shell 22B due to their magnetic attraction to core 22C and to their electrostatic attraction to shell 22B. A skive 22D removes the toner particle depleted developer mixture from shell 22B. As the trail edge of imaging member 12 leaves the interface between the shell and drum 16, the electrical bias to shell 22B is shut off, discontinuing the deposition of toner particles. The rotation of auger 22A is discontinued.

Process drum 16 is now accelerated to a higher surface speed such as 400 cm/s. A laser diode 24 emits a laser beam 26 which is intensity-modulated according to image information to be recorded. To imagewise heat the layer of toner particles, laser diode 24 is moved slowly from one edge of process drum 16 to the other edge. Thus, as the laser diode moves, image information is recorded in scan lines perpendicular to the axis of rotation of the drum.

Laser beam 26 is focused on either the toner particle layer or imaging member 12. The duration of laser exposure for each selected pixel is only long enough to generate enough heat to slightly melt selected toner particles. For example, at a drum surface speed of 400 cm/s a 20 micron diameter laser spot of 200 mW is used. This causes the selected toner particles to be lightly tacked to the imaging member. The laser exposure will also soften those portions of the thermoplastic layer adjacent the selected toner particles. This will assist in tacking the selected toner particles to imaging member 12 by allowing these particles to migrate slightly into the thermoplastic layer. The particles migrate into the thermoplastic layer due to the particles attraction to the grounded conductive layer. When the thermoplastic cools it will help secure the selected toner particles to imaging member 12. The selected toner particles need only be lightly tacked because a second magnetic brush, described below, gently removes nonselected toner particles from the imaging member without disturbing the lightly tacked selected toner particles. Because the selected toner particles need be only lightly tacked to imaging member 12 rather than completely fused, laser heating can be accomplished much faster. Images can be created at a higher rate.

After laser heating is complete, process drum 16 is decelerated to a surface velocity of about 10 cm/s. Imaging member 12 is rotated by drum 16 towards a magnetic brush 28 which contains a supply of hard magnetic carrier particles. "Hard" magnetic carrier particles are those particles which will flip-flop when exposed to alternating polarity magnetic fields. Typically, these particles have a coercivity in excess of 100 oersteds. Examples of materials from which such hard magnetic carrier particles can be made are barium ferrite and strontium ferrite.

A rotating auger 28A deposits a layer of hard magnetic carrier particles on a shell 28B. The carrier particles remain on the shell because of their magnetic attraction to a core 28C. Shell 28B and core 28C operate in a similar manner to shell 22B and core 22C. The relative movement between shell 28B and core 28C exposes the hard carrier particles to alternating polarity magnetic fields, causing the carrier particles to tumble about the surface of the shell.

As the lead edge of imaging member 12 approaches the interface between shell 28B and drum 16, an electric field of preferably between about 5 to 15 volts/mil is established between the shell and the conductive layer of imaging member 12. The electric field is established by placing a voltage of opposite polarity to the charge on the toner particles on the shell by an adjustable voltage supply V2. The imaging member is contacted by the hard carrier particles whose tumbling action knocks the nonselected toner particles loose from the imaging member while not disturbing the selected toner particles. The carrier and nonselected toner particles triboelectrically charge due to their interaction. Less than all of the nonselected toner particles are electrostatically attracted to the carrier particles on shell 28B. It is important that the bias placed on shell 28B not be too high as this will cause carrier particles to be deposited onto imaging member 12. This occurs because the electrical bias placed on shell 28B is of the same polarity as the charge on the carrier particles. If the bias is too high, the electrostatic repulsion of the carrier particles from shell 28B will overcome the magnetic attraction of the carrier particles to magnetic core 28C.

Nonselected toner particles on shell 28B are removed therefrom by an electrically biasable toner removal roller 36. A voltage is placed on the roller by a voltage supply V5. This voltage is selected such that an electric field is established between shell 28B and roller 36 which will cause toner particles on shell 28B to transfer to roller 36. Toner particles are removed from the roller by a stripping blade 38.

After imaging member 12 passes by magnetic brush 28, it is rotated by drum 16 so that the imaging member can pass by and be contacted by magnetic brush 28 a second time. During this second pass, an electric field of preferably less than about 10 volts/mil is established between shell **28*b* and the conductive layer of imaging member 12. Substantially all of any nonselected toner remaining on imaging member 12 is removed therefrom by magnetic brush 28. If necessary, imaging member 12 may be rotated past magnetic brush 28 as many times as required to remove the nonselected toner particles. A pick-off blade 30 is rotated from its solid line position to its phantom line position in order to remove imaging member 12 from drum 16. The imaging member passes through a fusing station 42 which permanently fuses the selected toner particles to the imaging member. The imaging member is deposited in an output tray 32. The rotation of auger 28A is discontinued and a skive 40 is rotated from its solid line position to its phantom line position to strip the hard magnetic carrier particles from the surface of shell 28B**.

Figure 2:
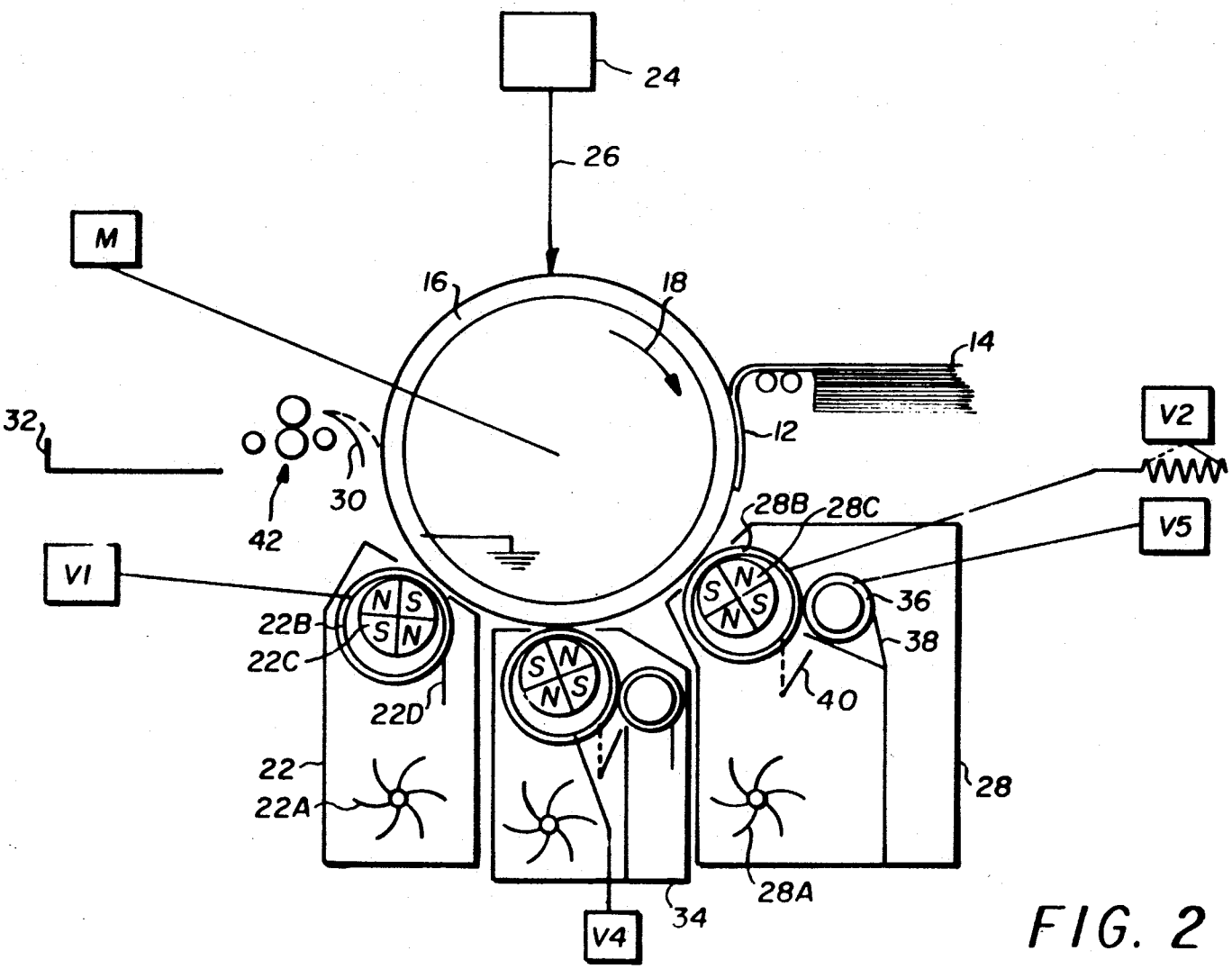
FIG. 2 is a side schematic illustration of an alternative embodiment of the invention.

Turning now to FIG. 2, another embodiment of an image reproduction apparatus is shown. This embodiment is similar to the embodiment shown in figure one except that a third electrically biased magnetic brush 34 has been added. Magnetic brush 34 functions the same as magnetic brush 28. In this embodiment, an electric field of preferably between about 5 to 15 volts/mil is established between imaging member 12 and brush 34 while an electric field of preferably less than about 10 volts/mil is established between imaging member 12 and brush 28. While in the embodiment of FIG. 1 imaging member 12 was passed two times by one magnetic brush 28, in this embodiment the imaging member is passed at least one time past two magnetic brushes 28 and 34. Preferably, magnetic brushes 28 and 34 are electrically isolated with brush 34 biased at a higher potential than brush 28. It is contemplated that more than two magnetic removal brushes can be used in this invention. Additionally, more than one pass can be made past the magnetic removal brushes.

The electric field levels described above are not contemplated to be limiting. The only requirement for the electric fields is that they be selected so that substantially all the nonselected toner particles are removed from the imaging member while causing virtually no carrier particles to be deposited on the imaging member.

The invention has been described in detail with particular reference to preferred embodiments thereof, but it will be understood that variations and modifications can be effected within the spirit and scope of the invention.

What is claimed is:

1. A method of producing an image on an imaging member, said method comprising the steps of:

depositing a substantially uniform layer of thermoplastic toner particles onto said imaging member;

imagewise heating selected toner particles such that the selected toner particles are lightly tacked to said imaging member; and contacting said imaging member with one electrically biased magnetic brush, which includes a supply of magnetic carrier particles, at least two times to remove nonselected toner particles from said imaging member.

2. The method of claim 1 wherein said magnetic brush includes a nonmagnetic, conductive shell on which said carrier particles are located and a rotating magnetic core within said shell, and wherein said magnetic carrier particles have a coercivity of greater than about 100 oersteds, said rotating magnetic core exposing said magnetic carrier particles to alternating polarity magnetic fields thereby causing said magnetic carrier particles to flip-flop about said shell.

3. The method of claim 1 wherein an electric field of between about 5 to 15 volts/mil is established between said imaging member and said magnetic brush during the first time the imaging member is contacted by said magnetic brush, and wherein an electric field of less than about 10 volts/mil is established between said imaging member and said magnetic brush during the second time the imaging member is contacted by said magnetic brush.

4. The method of claim 1 wherein said imaging member has an outer layer on which said toner particles are deposited, said outer layer including a thermoplastic material, and wherein said imagewise heating step softens those portions of the thermoplastic layer adjacent the selected toner particles, allowing the selected toner particles to migrate into said thermoplastic layer.

5. The method of claim 1 wherein said imagewise heating step is accomplished with a scanning, intensity-modulated laser beam.

6. The method of claim 1 wherein during the first time said magnetic brush contacts said imaging member said magnetic brush is electrically biased to a first potential, and during the second time said magnetic brush contacts said imaging member said magnetic brush is electrically biased to a second potential which is lower than said first potential.

7. A method of producing an image on an image member, said method comprising the steps of:

depositing a substantially uniform layer of thermoplastic toner particles onto an imaging member;

imagewise heating selected toner particles such that the selected toner particles are lightly tacked to said imaging member; and contacting said imaging member with at least two electrically biased magnetic brushes, said magnetic brushes each including a supply of magnetic carrier particles, said imaging member being contacted by said magnetic brushes at least once to remove nonselected toner particles from said imaging member, the first magnetic brush to contact the imaging member being biased at a higher potential than the second magnetic brush.

8. The method of claim 7 wherein said magnetic brushes each include a nonmagnetic, conductive shell on which said carrier particles are located and a rotating magnetic core within said shell, and wherein said magnetic carrier particles have a coercivity of greater than about 100 oersteds, said rotating magnetic cores exposing said magnetic carrier particles to alternating polarity magnetic fields thereby causing said magnetic carrier particles to flip-flop about said shells.

9. The method of claim 7 wherein an electric field of between about 5 to 15 volts/mil is established between one of said magnetic brushes and said imaging member, and wherein an electric field of less than about 10 volts/mil is between said imaging member and said other magnetic brush.

10. The method of claim 7 wherein said imaging member has an outer layer on which said toner particles are deposited, said outer layer including a thermoplastic material, and wherein said imagewise heating step softens those portions of the thermoplastic layer adjacent the selected toner particles, allowing the selected toner particles to migrate into said thermoplastic layer.

11. The method of claim 7 wherein said imagewise heating step is accomplished with a scanning, intensity modulated laser beam.

12. An apparatus for producing an image on an imaging member, said apparatus comprising:

means for depositing a substantially uniform layer of thermoplastic toner particles onto said imaging member;

means for imagewise heating selected toner particles such that the selected toner particles are lightly tacked to said imaging member; and a single electrically biased magnetic brush which includes a supply of magnetic carrier particles, said imaging member being contacted by said magnetic brush at least two times to remove nonselected toner particles from said imaging member.

13. The apparatus of claim 12 wherein said magnetic carrier particles have a coercivity of greater than about 100 oersteds.

14. The apparatus of claim 12 wherein an electric field of between about 5 to 15 volts/mil is established between said magnetic brush and said imaging member during the first time the imaging member is contacted by said magnetic brush and wherein an electric field of less than about 10 volts/mil is established between said magnetic brush and said imaging member during the second time the imaging member is contacted by said magnetic brush.

15. The apparatus of claim 12 wherein said imaging member has an outer layer on which said toner particles are deposited, said outer layer including a thermoplastic material, and wherein said imagewise heating step softens those portions of the thermoplastic layer adjacent the selected toner particles, allowing the selected toner particles to migrate into said thermoplastic layer.

16. The apparatus of claim 12 wherein said imagewise heating means includes a scanning, intensity-modulated laser beam.

17. Apparatus for producing an image on an image member, said apparatus comprising:

means for depositing a substantially uniform layer of thermoplastic toner particles onto said imaging member;

means for imagewise heating selected toner particles such that the selected toner particles are lightly tacked to said imaging member; and at least two electrically biased magnetic brushes, said magnetic brushes each including a supply of magnetic carrier particles, said imaging member being contracted by said magnetic brushes at least once to remove nonselected toner particles from said imaging member, the first magnetic brush to contact the imaging member being biased at a higher potential than the second magnetic brush.

18. The apparatus of claim 17 wherein said magnetic carrier particles have a coercivity of greater than about 100 oersteds.

19. The apparatus of claim 17 wherein an electric field of between about 5 to 15 volts/mil is established between one of said magnetic brushes and said imaging member, and wherein an electric field of less than about 10 volts/mil is established between said other magnetic brush and said imaging member.

20. The apparatus of claim 17 wherein said imaging member has an outer layer, on which said toner particles are deposited, which is made of thermoplastic, and wherein said imagewise heating step softens those portions of the thermoplastic layer adjacent the selected toner particles, allowing the selected toner particles to migrate into said thermoplastic layer.

21. The apparatus of claim 17 wherein said imagewise exposing means includes a scanning, intensity modulated laser beam.

* * * * *